US009719154B2

(12) United States Patent
Takahashi et al.

(10) Patent No.: US 9,719,154 B2
(45) Date of Patent: Aug. 1, 2017

(54) TITANIUM SLAB FOR HOT ROLLING, AND METHOD OF PRODUCING AND METHOD OF ROLLING THE SAME

(75) Inventors: Kazuhiro Takahashi, Tokyo (JP); Tomonori Kunieda, Tokyo (JP); Kenichi Mori, Tokyo (JP); Hiroaki Otsuka, Tokyo (JP); Hideki Fujii, Tokyo (JP); Yoshihiro Fujii, Tokyo (JP); Yoshimasa Miyazaki, Tokyo (JP); Takashi Oda, Chigasaki (JP); Hisamune Tanaka, Chigasaki (JP); Osamu Tada, Chigasaki (JP)

(73) Assignees: NIPPON STEEL & SUMITOMO METAL CORPORATION, Tokyo (JP); TOHO TITANIUM CO., LTD., Chigasaki-Shi, Kanagawa (JP)

( * ) Notice: Subject to any disclaimer, the term of this patent is extended or adjusted under 35 U.S.C. 154(b) by 938 days.

(21) Appl. No.: 13/148,395

(22) PCT Filed: Feb. 8, 2010

(86) PCT No.: PCT/JP2010/052130

§ 371 (c)(1),
(2), (4) Date: Aug. 8, 2011

(87) PCT Pub. No.: WO2010/090353

PCT Pub. Date: Aug. 12, 2010

(65) Prior Publication Data

US 2011/0311835 A1 Dec. 22, 2011

(30) Foreign Application Priority Data

Feb. 9, 2009 (JP) ..... 2009-026922

(51) Int. Cl.
*C22C 14/00* (2006.01)
*B22D 21/00* (2006.01)
(Continued)

(52) U.S. Cl.
CPC ..... *C22B 34/1295* (2013.01); *B22D 11/00* (2013.01); *B22D 11/041* (2013.01);
(Continued)

(58) Field of Classification Search
CPC ..... C22C 1/02; C22C 1/005; C22C 14/00
(Continued)

(56) References Cited

U.S. PATENT DOCUMENTS 3,447,592 A * 6/1969 Wertli ..... 164/443
4,838,933 A 6/1989 Paillere et al.
(Continued)

FOREIGN PATENT DOCUMENTS

JP 55-81006 A 6/1980
JP 62-50047 A 3/1987
(Continued)

OTHER PUBLICATIONS

Computer-generated translation of JP 2007-039807 (Shinraki et al.), originally published in the Japanese language on Jul. 6, 2006.*
(Continued)

*Primary Examiner* — Scott Kastler
*Assistant Examiner* — Vanessa Luk
(74) *Attorney, Agent, or Firm* — Birch, Stewart, Kolasch & Birch, LLP

(57) ABSTRACT

The present invention provides a titanium slab for hot rolling which can be fed into a general purpose hot-rolling mill for producing strip coil, without passage through a breakdown process such as blooming or a straightening process, and can further suppress surface defect occurrence of the hot-rolled strip coil, and a method of producing and a method of rolling the same, characterized in that in the cast titanium slab an angle θ formed by the crystal growth direction (solidification direction) from the surface layer toward the interior and a direction parallel to the slab casting direction (longitudinal
(Continued)

direction) is 45 to 90°, and moreover, there is a surface layer structure of 10 mm or greater whose θ is 70 to 90°, and further characterized in that a crystal grain layer of 10 mm or greater is formed whose C-axis direction inclination of a titanium α phase is, as viewed from the side of the slab to be hot rolled, in the range of 35 to 90° from the normal direction of the surface to be hot rolled. The titanium slab concerned is produced using an electron beam melting furnace by casting at an extraction rate of 1.0 cm/min or greater.

6 Claims, 3 Drawing Sheets

(51) Int. Cl.

| | |
|---|---|
| ***B22D 11/041*** | (2006.01) |
| ***C22F 1/18*** | (2006.01) |
| ***C22B 34/12*** | (2006.01) |
| ***B22D 11/00*** | (2006.01) |
| ***B22D 11/115*** | (2006.01) |

(52) U.S. Cl.
CPC ..... *B22D 11/115* (2013.01); *B22D 21/005* (2013.01); *C22C 14/00* (2013.01); *C22F 1/183* (2013.01); *Y10T 428/12229* (2015.01)

(58) Field of Classification Search
USPC ..... 148/538, 539, 557, 668–671, 421, 501; 420/417–421; 164/47, 48, 459–491, 164/492–501
See application file for complete search history.

(56) References Cited

U.S. PATENT DOCUMENTS

| | | | | |
|---|---|---|---|---|
| 5,028,277 | A * | 7/1991 | Mizoguchi et al. | 428/660 |
| 5,942,057 | A * | 8/1999 | Hanamura | C22C 32/0031 148/421 |

FOREIGN PATENT DOCUMENTS

| | | | | |
|---|---|---|---|---|
| JP | 63-165054 | A | 7/1988 | |
| JP | 63-192543 | A | 8/1988 | |
| JP | 2-121765 | A | 5/1990 | |
| JP | 7-102351 | A | 4/1995 | |
| JP | 07316683 | A * | 12/1995 | C22C 1/02 |
| JP | 8-81747 | A | 3/1996 | |
| JP | 2007-39807 | A | 2/2007 | |
| JP | 2007-332420 | A | 12/2007 | |

OTHER PUBLICATIONS

Computer-generated translation of JP 2007-332420 (Mori et al.), originally published in the Japanese language on Jun. 15, 2006.*
"Effects of Composition, Processing, and Structure on Properties of Nonferrous Alloys: Titanium and Titanium Alloys," Materials Selection and Design, vol. 20, ASM Handbook, ASM International, 1997, pp. 399-404.*
International Search Report issued in PCT/JP2010/052130, mailed May 11, 2010.
Murase et al., "Quality and Characteristics of Titanium Ingots Produced in a Plasma Electron Beam Furnace," Nippon Stainless Technical Report, No. 15, pp. 105-117, 1980 (with partial English translation).
Nagai et al., "Production of Titanium Ingots in a Vacuum Plasma Furnace, Introduction to Vacuum Plasma Furnace," Nippon Stainless Technical Report, No. 10, pp. 65-81, 1973 (with partial English language translation).
Japanese Office Action dated Sep. 11, 2012, for Japanese Application No. 2010-529177.
C. Entrekin, et al., "Electron Beam Cast Titanium Slab", Proceedings of the 1984 Vacuum Metallurgy Conference on Specialty Metals Melting and Processing, Jan. 1, 1985, Pittsburgh, PA (pp. 45-48) (in English).
Extended European Search Report issued in corresponding European Patent Application No. 10738679.9 on Jul. 31, 2015 (in English).
Y. Kotani et al., "Production of Titanium Slab Ingots in a Plasma Electron Beam Furnace", Titanium '80: Science and Technology; Proceedings of the Fourth International Conference on Titanium, Kyoto, Japan, May 19-22, 1980, vol. 3, May 19, 1980, pp. 2147-2151 (in English).

* cited by examiner

θ : ANGLE FORMED BY DIRECTION PARALLEL TO CASTING DIRECTION AND CAST STRUCTURE SOLIDIFICATION DIRECTION

TITANIUM SLAB FOR HOT ROLLING, AND METHOD OF PRODUCING AND METHOD OF ROLLING THE SAME

FIELD OF THE INVENTION

This invention relates to a titanium slab for hot rolling, a method of producing the titanium slab, and a method of rolling the same, particularly to a method directly producing a titanium slab favorable for hot rolling the aforesaid titanium slab with an electron beam melting furnace. More specifically, it relates to a titanium slab for hot rolling produced directly from an electron beam melting furnace that makes it possible to favorably maintain the surface properties of a hot-rolled strip coil even if a process for hot-working an ingot, such as blooming, forging, rolling or the like is omitted, a method of producing the same, and a method of rolling the same.

BACKGROUND ART

The ordinary method of producing a titanium strip coil is explained in the following. The method starts with a large ingot obtained by melting using the consumable electrode arc melting method or electron beam melting method and solidification. In the case of the consumable electrode arc melting method, the shape of this large ingot is a cylinder of about 1 meter diameter, while in the case of the electron beam melting method a rectangular shape is also produced that has a cross-section of about 0.5 to 1 m per side. Since the cross-section is so large, the large ingot is subjected to blooming, forging, hot rolling or other hot-working (hereinafter sometimes called the "breakdown process") to be given a slab shape that can be rolled with a hot-rolling mill.

Following the breakdown, the slab is made into a slab for hot rolling by further passage through a straightening process for enhancing flatness and treatments for removing surface scale and defects. This slab for hot rolling is processed into a strip coil (sheet) by heating to a prescribed temperature and hot rolling with a general purpose hot-rolling mill for steel or the like.

This hot-rolled strip coil may thereafter become a finished product in its form as annealed and/or descaled or become a finished product upon being further subjected to cold rolling or other cold working and annealing. In the descaling process after hot rolling, the surface scale and defects are removed, but the surface must be removed deeper in proportion as the surface defects are deeper, so that yield declines.

On the other hand, in the case of, for example, the electron beam melting method and plasma arc melting method, which use a hearth, the melting of the raw material is conducted with a controlled hearth independent of the mold, which increases mold shape freedom compared to vacuum arc melting, and as a result has the feature of enabling production of an ingot of rectangular cross-section.

In the case of producing flat material or strip coil from a rectangular ingot produced by the electron beam melting method or plasma arc melting method, it is possible in light of the ingot shape aspect to omit the aforesaid breakdown process, which leads to production cost reduction. Therefore, consideration is being given to technologies for producing rectangular ingots thin enough to be directly fed into a hot-rolling mill (sometimes called "as-cast slab").

In producing such a thin titanium slab, a thinner rectangular mold than heretofore is required, and while fabrication of such a mold is not itself difficult, the casting surface properties and cast structure are considerably affected by the thickness and/or width of the mold and the casting conditions.

As for the casting surface properties of the as-cast slab, when pits/bumps, wrinkles or other deep defects are present, even if the surface of the as-cast slab is smoothed by machining or other treatment, any remaining bottom portions of the defects, even if slight, may become surface defects that become prominent after hot rolling. To avoid this, a process for treating and removing the surface of the as-cast slab to a considerable thickness becomes necessary.

Further, as shown in FIGS. 2 and 3, the as-cast structure is composed of coarse crystal grains of up to several tens of mm, and if this is directly hot rolled without being passed through a breakdown process, the coarse crystal grains cause uneven deformation that sometimes develop into large surface defects. As a result, yield is considerably degraded after hot rolling in the descaling process for removing surface defects, product inspection, and so on.

Therefore, with a titanium material, when the breakdown process is omitted, post-hot-rolling surface defects must be minimized as much as possible. Methods for smoothing the slab casting surface have been proposed to resolve this issue.

As technologies for improving the casting surface have been disclosed a method of extracting a titanium slab produced with an electron beam melting furnace from the mold and immediately feeding it to a surface shaping roll to smooth the cast slab surface (Patent Document 1) and a method of improving the casting surface of a cast slab by directing an electron beam onto the surface of a titanium slab extracted from a mold that is a component of an electron beam melting furnace to melt a surface layer portion and then feeding it to a surface shaping roll to produce a slab (Patent Document 2).

Even if the casting surface of a titanium slab produced with an electron beam melting furnace is smoothed by means like in Patent Document 1 or Patent Document 2, as pointed out above, defects often occur on the hot-rolled flat material owing to the cast structure of the original titanium slab.

In addition, Patent Document 1 and Patent Document 2 require an electron gun for titanium slab heating to be separately provided at the surface shaping roll or inside the electron beam melting furnace following extraction from the mold, so that an issue remains from the cost aspect.

As a melting method other than the electron beam melting method, the vacuum plasma melting furnace is sometime used. Non-patent Document 1 and Non-patent Document 2 disclose technologies for directly hot rolling a titanium slab produced with a vacuum plasma melting furnace into a strip coil (sheet).

In the technologies disclosed in Non-patent Document 1 and Non-patent Document 2, the melting rate is 5.5 kg/min, and because of the cross-sectional shape of the mold, the slab extraction rate is very slow, at about 0.38 cm/min, and the coil after hot rolling is passed through a grinding line (hereinafter sometimes called a "CG line").

Because of this, the post-hot-rolled coil has surface defects and it is thought that the defects are removed by the CG line. Thus, like the titanium slab produced with an electron beam melting furnace, a problem exists in that defects occur on the surface of the hot-rolled flat material.

Further, the vacuum plasma melting method (plasma arc) does not permit deflection as with the electron beam for electron beam melting, making it awkward at regulating the irradiation site in the melting furnace and the balance of the amount of heat supplied, so that control of the casting surface and/or cast structure is not easy.

Thus, in the titanium slab produced with an electron beam melting furnace or the like, surface defects are produced by the hot rolling of the strip coil (flat material) owing to both the remaining casting surface defects and the cast structure, and a technology for producing a titanium slab suitable for hot rolling is therefore desired.

PRIOR ART REFERENCES

Patent Documents

Patent Document 1 Unexamined Patent Publication (Kokai) No. 63-165054

Patent Document 2 Unexamined Patent Publication (Kokai) No. 62-050047

Non-Patent Documents

Non-patent Document 1 Keizo MURASE, Toshio SUZUKI, Shunji KOBAYASHI, "Quality and Characteristics of Titanium Ingots Produced in a Plasma Electron Beam Furnace," Nippon Stainless Technical Report, No. 15, pp 105-117, 1980

Non-patent Document 2 Motohiko NAGAI, Keizo MURASE, Toshio SUZUKI, Tadahiko KISHIMA, "Production of Titanium Ingots in a Vacuum Plasma Furnace, Introduction to Vacuum Plasma Furnace," Nippon Stainless Technical Report, No. 10, pp 65-81, 1973

SUMMARY OF THE INVENTION

Problem to be Solved by the Invention

As set out above, a problem exists of surface defects occurring when a titanium slab produced in an electron beam melting furnace or the like is hot rolled into a strip coil (flat material). The present invention has as its object to provide a titanium slab for hot rolling and a method of producing and a method of rolling the titanium slab, particularly a titanium slab which enables a titanium slab produced in an electron beam melting furnace to be fed into a general purpose hot-rolling mill used, for example, for steel to produce strip coil, without passage through a breakdown process such as blooming or a straightening process, and that can suppress occurrence of strip coil (flat material) surface defects after hot rolling, and a method of producing the titanium slab using the aforesaid electron beam melting furnace, and further a method of rolling the titanium slab for hot rolling.

Means for Solving the Problem

In order to achieve the aforesaid object, the relationship between the solidified structure of a titanium slab produced with an electron beam melting furnace and the rolling direction of the slab was investigated in detail, from which it was found that in the cast titanium slab the solidification direction, i.e., the crystal growth direction from the surface layer toward the interior, has a strong correlation with the titanium slab casting surface and the surface defect incidence rate during hot rolling, and was further discovered that the casting surface can be improved and surface defects during hot rolling minimized by controlling the solidification direction during slab production, whereby the present invention was achieved.

Specifically, the titanium slab for hot rolling according to invention (1) of this application is characterized in that in the cross-sectional structure parallel to the casting direction of the titanium slab the angle formed by the casting direction and the solidification direction is in the range of 45 to 90°.

As defined in the present invention, by casting direction here is meant the extraction direction of the titanium slab produced in the mold that is a component of the electron beam melting furnace, and by solidification direction is meant the growth direction of the crystals constituting the solidification structure formed in the microstructure of the titanium slab, the growth direction of crystals from the slab thickness surface toward the thickness center.

(2) A preferred mode of the titanium slab for hot rolling according to the invention of this application is defined wherein the surface layer portion of the titanium slab has a surface layer structure of a thickness of 10 mm or greater wherein the angle formed by the casting direction and the solidification direction is in the range of 70 to 90°.

Moreover, (3) a preferred mode of the titanium slab for hot rolling according to the invention of this application is defined wherein a titanium slab cast using an electron beam melting furnace is formed with a crystal grain layer of 10 mm or greater whose C-axis direction inclination of the hexagonal-close-packed structure that is the titanium $\alpha$ phase is, as viewed from the side of the slab to be hot rolled, in the range of 35 to 90° from the normal direction of the surface to be hot rolled (where ND direction is defined as 0°).

Further, (4) a preferred mode of the titanium slab for hot rolling according to the invention of this application is defined wherein the thickness of the titanium slab for hot rolling is 225 to 290 mm and ratio W/T of width W to thickness T is 2.5 to 8.0.

(5) A preferred mode of the titanium slab for hot rolling according to the invention of this application is defined wherein the ratio L/W of the length L to the width W of the titanium slab for hot rolling is 5 or greater and L is 5000 mm or greater.

(6) A preferred mode of the titanium slab for hot rolling according to the invention of this application is defined wherein the titanium slab for hot rolling is made of commercially pure titanium.

(7) A preferred mode of the titanium slab for hot rolling according to the invention of this application is defined wherein the titanium slab for hot rolling is cast using an electron beam melting furnace.

(8) The method of producing a titanium slab for hot rolling according to the invention of this application is characterized in that it is a method of producing a slab for hot rolling using an electron beam melting furnace characterized in that the extraction rate of the titanium slab is in the range of 1.0 cm/min or greater.

In addition, (9) a method of rolling a titanium slab for hot rolling according to the present invention is characterized in that the titanium slab for hot rolling is fed into a hot-rolling mill to be hot rolled into a strip coil.

Note that the as-cast titanium slab according to the invention of this application is submitted to hot rolling after removing pits, bumps and other defects on the casting surface before hot rolling by machining or other treatment, or when the casting surface is smooth and in good condition, such aforesaid treatment is omitted. Therefore, the aforesaid cross-sectional structure of the titanium slab for hot rolling is the state before hot rolling and in the case where the casting surface is treated by machining or the like means the cross-sectional structure after the treatment.

Effect of the Invention

The present invention exhibits an effect enabling a titanium slab hot rolled into a flat material, particularly a titanium slab produced with an electron beam melting furnace, to be fed into a general purpose hot-rolling mill used, for example, for steel to produce strip coil, as is without the cast slab after production being subjected to a breakdown process such as blooming or a straightening process. It further exhibits an effect enabling minimization of surface defects on the strip coil (flat material) formed by the hot rolling.

BEST MODE FOR CARRYING OUT THE INVENTION

Optimum embodiments of the present invention are explained below using the drawings.

Figure 1:
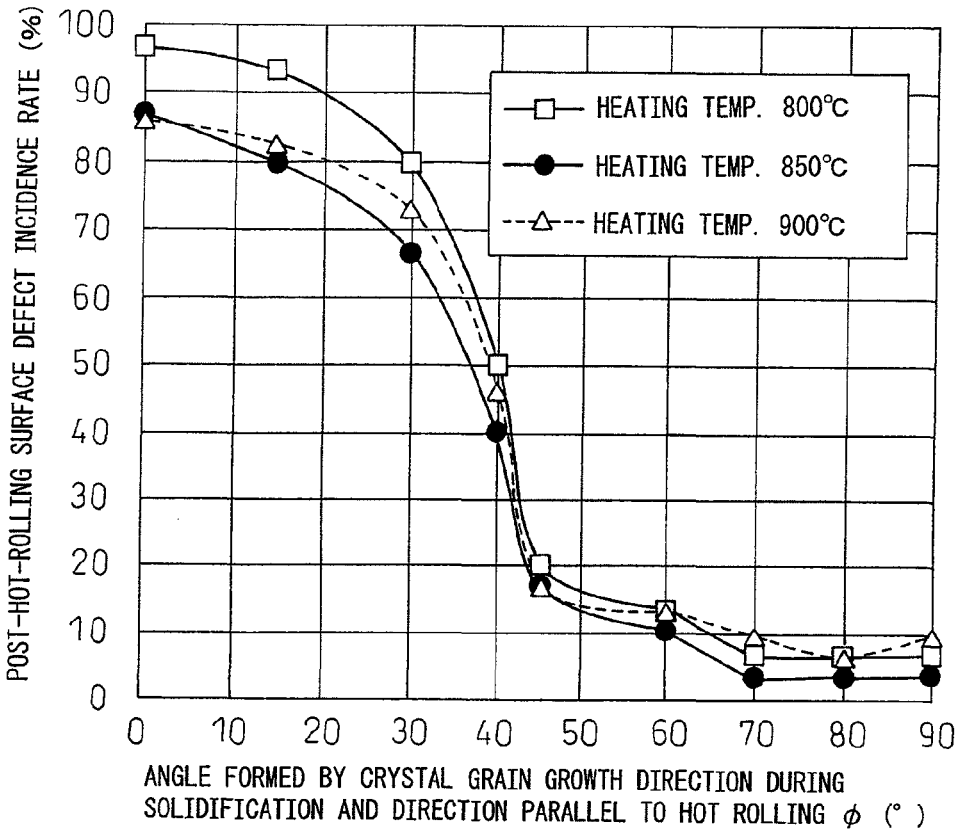
FIG. 1 a diagram showing the relationship between the angle formed by the crystal grain growth direction during solidification and a direction parallel to the rolling direction of the hot-rolled material (longitudinal direction), and the post-hot-rolling surface defect incidence rate.

FIG. 1 shows the relationship between the angle (hereinafter ϕ) formed by the crystal grain growth direction during solidification and a direction parallel to the rolling direction of the hot-rolled material (longitudinal direction), and the surface defect incidence rate after the material to be rolled was hot rolled. This ϕ corresponds to the angle (θ) formed by the titanium slab solidification direction and a direction parallel to the casting direction.

Figure 2:
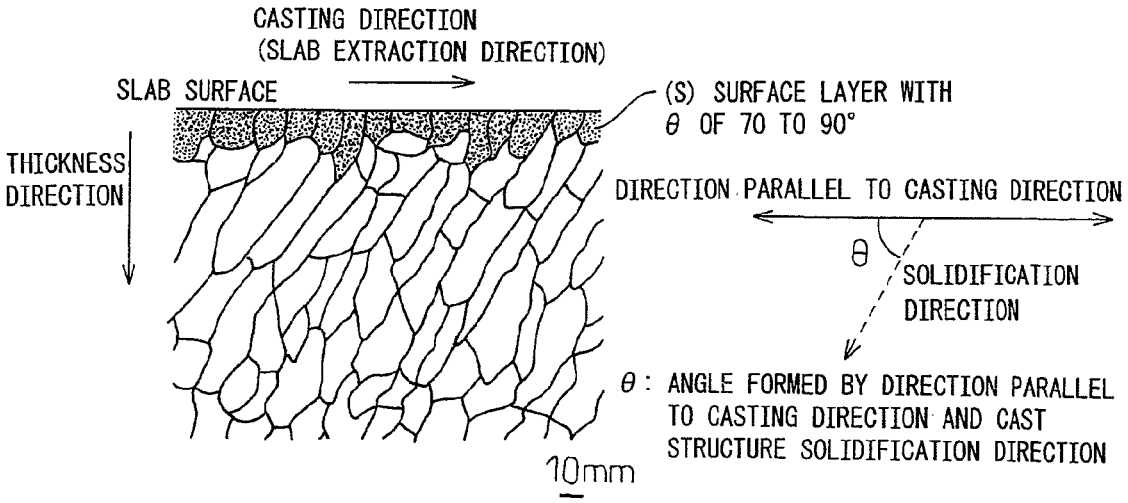
FIG. 2 is a diagram showing the relationship between the solidified structure of a cross-section parallel to the casting direction of a titanium slab for hot rolling according to the invention of this application, and the angle (θ) formed by the solidification direction thereof (crystal grain growth direction) and a direction parallel to the casting direction.
Figure 3:
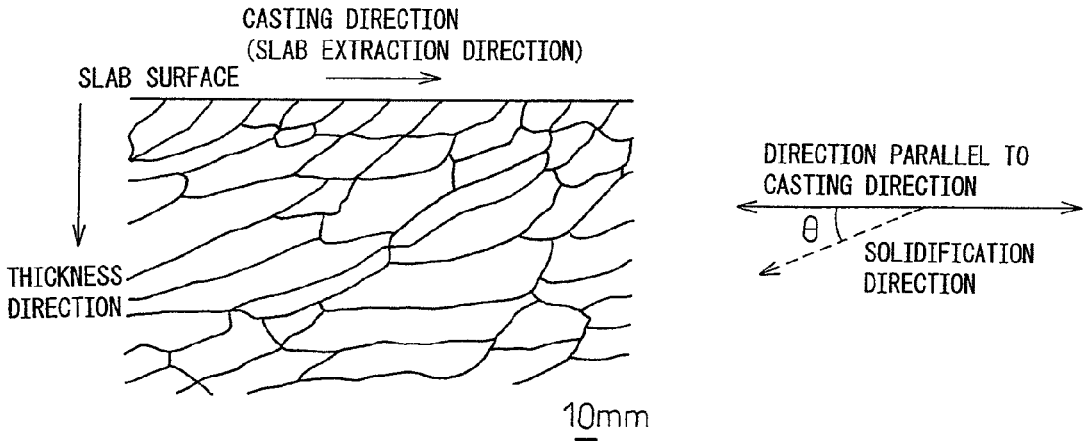
FIG. 3 is a diagram showing the solidified structure of a cross-section parallel to the casting direction of the titanium slab for hot rolling when θ is small, and the angle (θ) formed by the solidification direction thereof (crystal grain growth direction) and a direction parallel to the casting direction.

The cast titanium slab has a cast structure like that shown in FIGS. 2 and 3, and two materials for rolling (thickness: 50 mm, width: 130 mm, length: 170 mm) for each test level were cut from a cast slab of JIS type 2 commercially pure titanium (JIS H 4600) and processed so that ϕ assumed various angles of 0 to 90°. The material to be rolled was heated to 800° C., 850° C. or 900° C. and then hot rolled to a thickness of 5 mm.

This hot-rolled flat material was then subjected to shot-blasting, the surface defects that occurred were marked, and the incidence rate evaluated. Note that the surface defects had burrs owing to the shot blasting, and the surface defects could be easily detected by touching the surface with a work-gloved hand. The hot-rolled flat material, except for the unsteady portions at the leading and trailing ends of the rolling, was segmented at 100 mm intervals, and the ratio obtained by dividing the number of sections with portions where surface defects were detected by the total number of sections (total of 30 sections for two hot-rolled flat materials) was defined as the surface defect incidence rate.

As shown in FIG. 1, at all heating temperatures, the surface defect incidence rate was very high and exceeded 60% when ϕ was small at 30° or less, but declined to 20% or less when ϕ was 45° or greater and further stabilized at a low level of 10% or less when it was 70° or greater.

The aforesaid FIG. 1 data show that for suppressing the surface defect incidence rate during hot rolling it is very important in implementing the invention of this application to control the angle formed by the crystal grain growth direction (solidification direction) and titanium slab longitudinal direction corresponding to the casting direction. Note that the surface shot-blasted as mentioned above is observed as is in FIG. 1 (is a surface not pickled with nitric-hydrofluoric acid), and the state of surface defect occurrence is quite rigorously evaluated.

Next, explanation is given regarding the solidified structure of the titanium slab for hot rolling according to the invention of this application.

FIG. 2 shows the solidified structure in a cross-section parallel to the casting direction of the titanium slab for hot rolling according to the invention of this application and the angle (hereinafter θ) formed by this solidification direction and a direction parallel to the casting direction. This θ corresponds to the aforesaid ϕ explained for FIG. 1.

The type of the titanium slab shown in FIG. 2 is the case of JIS type 2 commercially pure titanium (JIS H 4600), and in the cross-sectional macrostructure of the slab obtained by the procedure set out below, the crystal grains have been traced for easier recognition of the solidification direction (crystal grain growth direction).

Further, as an example departing from the invention of this application (a comparative example), FIG. 3 shows the solidified structure in a cross-section parallel to the casting direction of a titanium slab and the angle θ formed by this solidification direction and a direction parallel to the casting direction. In the solidified structure shown in FIG. 3, the crystal grains have been traced in the macrostructure of the slab cross-section for easier recognition of the solidification direction (crystal grain growth direction).

Figure 4:
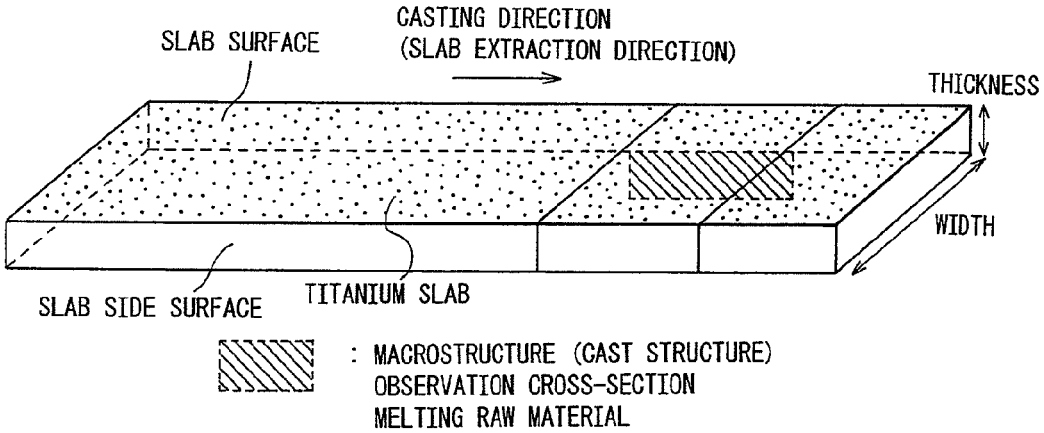
FIG. 4 is a perspective view showing a cross-section for observing the solidification structure of a titanium slab.

FIG. 4 is a perspective view showing a cross-section for observing the solidification structure. The solidified structure (cast structure) can be observed and the aforesaid θ measured by cutting from a titanium slab produced with an electron beam melting furnace a slab longitudinal cross-section parallel to the slab extraction direction, i.e. the casting direction, (rectangular surface indicated by hatching in FIG. 4), and etching it after polishing.

Specifically, 50 crystal grains were arbitrarily selected from among those in the aforesaid cross-section that intersected a straight line parallel to the casting direction at a level of ¼ the slab thickness (depth of about 60 to 70 mm), and the average of the principal axis angles θ (corresponding to θ in invention of this application) was calculated by image analysis.

Namely, in each of the approximate ellipses corresponding to the individual crystal grains (ellipses equal in area to the respective crystal grains), the major axis length a, minor axis length b and principal axis angle θ (θ: angle of a value of 0 to 90° formed by a straight line at a level of ¼ the slab thickness and the principal axis through which the major axis length of the approximate ellipse concerned passes) of the approximate ellipse concerned were determined by the method of least squares so as to minimize the sum of the squares of the distances from the approximate ellipse concerned and the profile of the crystal grain concerned.

The result was that the average values of the principal axis angles θ of the solidified structures obtained in FIGS. 2 and 3 were 61° and 22°, respectively.

Figure 5:
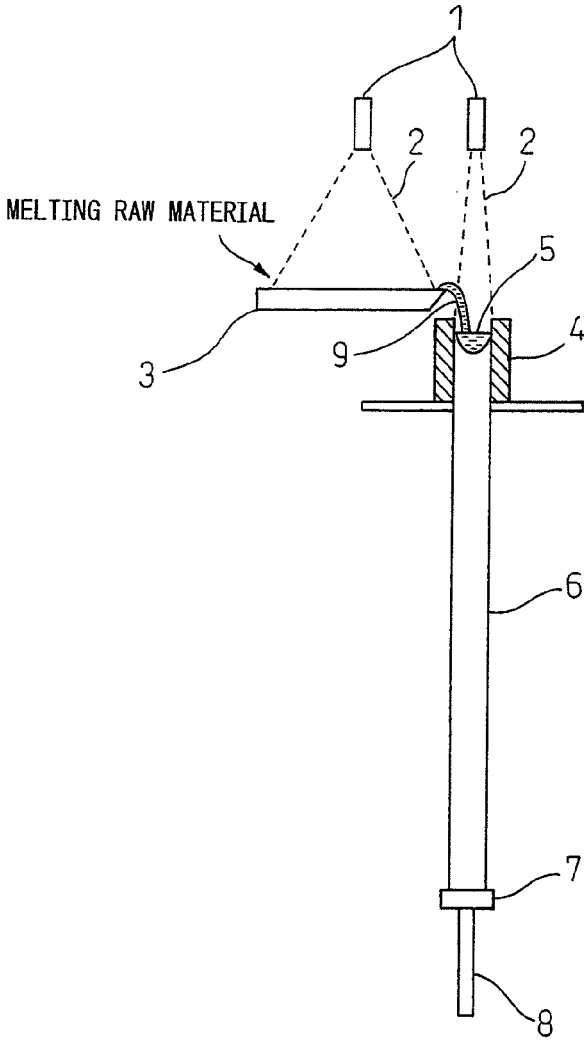
FIG. 5 is a diagram schematically illustrating an electron beam melting furnace.

FIG. 5 schematically illustrates an electron beam melting furnace. The titanium slab 6 according to the invention of this application has a solidified structure formed by the cooling process in a mold 4, and the solidified structure can be controlled by the heat supply by an electron gun 1 and the place irradiated thereby, the casting rate (extraction rate), the cooling capacity of the mold 4, and the like so as to be formed to make a substantially constant angle with respect to the solidification direction of the titanium slab 6.

By establishing the angle θ formed by a direction parallel to the aforesaid solidification direction and the casting direction in the range of 45 to 90° as in the solidified structure of FIG. 2, the invention according to invention (1) of this application exhibits an effect of suppressing casting surface pits/bumps and other surface defects and also of minimizing surface defects after hot rolling.

When θ is small and less than 45° as in the solidified structure of FIG. 3, the shape becomes more extended in the slab extraction directions, i.e., the slab longitudinal direction. Such a solidified structure occurs readily under conditions of a relatively low solidification rate and shallow molten pool 5 of FIG. 5.

When the aforesaid slab is hot rolled, pits that become starting points of surface defects occur at the initial stage of the rolling and change into surface defects as the ensuing hot rolling progresses, which is undesirable.

Although the mechanism by which these pits occur is uncertain on some points, the reason is thought to be that, as viewed from the front surface side of the slab (top side in FIG. 3), the apparent crystal grains are large owing to the solidified structure being extended in the longitudinal direction, so that large wrinkles tend to occur under reduction in the vertical direction (shear deformation). It is also conceivable that the occurrence mechanism involves not only coarse crystal grains but also crystal orientation, such as ridging phenomena and/or roping phenomena.

In contrast, in the solidified structure of the present invention shown in FIG. 2, θ is 45 to 90°, i.e., the solidification direction is closer to perpendicular with respect to the slab surface, so that pit occurrence at the start of rolling is suppressed, and as a result, an effect is exhibited of post-hot-rolling surface defects being minimized.

This is presumed to be because when viewed from the front surface side of the slab (top side in FIG. 2), the apparent crystal grains are smaller than in the case of FIG. 3. Preferably, as shown in FIG. 1, θ is 70 to 90°, and in invention (2) of this application, the slab surface layer is made to have a surface layer structure whose θ is 70 to 90° of a thickness of 10 mm or greater, because this enables the post-hot-rolled surface defects to be made very minimal.

The aforesaid surface structure with θ of 70 to 90° is the layer occupied by crystal grains indicated by dots of (S) immediately under the surface of the slab shown in FIG. 2. When the average depth from the surface layer of 50 arbitrary crystal grains among the crystal grains of said surface layer structure is less than 10 mm, adequate surface defect suppression effect sometimes cannot be obtained because the layer present in the surface layer is thin.

In order to study the aforesaid involvement of the crystal orientation, and in light of the fact that post-hot-rolling surface defects can be extremely minimized, the α phase crystal orientation of titanium composed of hexagonal-close-packed structure was, for titanium slabs produced using an electron beam melting furnace, measured by the Laue X-ray method in a slab surface layer portion with θ of 70 to 90° and a slab surface layer portion whose θ deviated from the foregoing, and the crystal orientation distributions were compared.

As a result, it was newly found that in a surface layer portion with θ of 70 to 90° the C-axis direction inclination of the titanium α phase (hexagonal-close-packed structure) as viewed from the side of the slab surface to be hot rolled (abbreviated as α) was distributed from the normal direction of the surface to be hot rolled (where ND direction is defined as 0°) to not less than 35° and up to a position near 90° and no ϕ at all was distributed at 0 to less than 35°. On the other hand, when θ was less than 70°, ϕ also came to be distributed in the 0 to 35° region, with the result that ϕ came to be distributed within the entire 0 to 90° region. Moreover, it was found that when θ was less than 45°, ϕ came to be distributed within the entire 0 to 90° region randomly with less bias, and ϕ was also abundantly distributed at less than 35°. In other words, this indicates that the crystal orientation of the C-axis of α phase with ϕ of less than 35° is nearly perpendicular to the slab surface to be rolled and such a crystal orientation is inhibited by making θ 70 to 90°. When, to the contrary, θ is less than 70°, i.e., the fact that ϕ is also distributed at less than 35°, is thought to cause occurrence of post-hot-rolling surface defects.

Note that the specimen for macrostructure observation used when determining the aforesaid θ (cut, polished and etched slab longitudinal direction cross-section parallel to the slab extraction direction, i.e., the casting direction) was used in the Laue X-ray measurement. At a depth level of 10 mm from the slab surface to be hot rolled, a W-target X-ray beam (beam diameter: 0.5 mm) was directed into the crystal grains at each of 40 to 50 points per specimen, the Laue diffraction spots of the titanium α phase (hexagonal-close-packed structure) were measured by the back-reflection Laue method, and the crystal orientation of the titanium α phase (hexagonal-close-packed structure) was determined from the Laue diffraction spots using a Laue analysis program (Laue Analysis System (unregistered trademark) Ver. 5.1.1, product of Norm Engineering Co., Ltd.). The value of ϕ at each measurement point was obtained from the determined a phase crystal orientation. Since this ϕ is the C-axis direction inclination from the direction of the normal to the slab surface to be hot rolled (where ND direction is defined as 0°), its minimum is 0° and maximum 90°.

Here, it was ascertained that also at a depth position of 5 mm from the surface to be hot rolled of the slab according to the present invention, the same distribution of ϕ was exhibited as at the aforesaid depth position of 10 mm, and since, as shown in the traced diagram of the crystal grains of FIG. 2, up to a depth of 10 mm is within the first stage of crystal grains of the surface layer, ϕ can be said to be distributed to 35° and greater within a depth of 10 mm from the surface to be hot rolled.

From the foregoing, the invention (3) of this application is characterized in that the titanium slab cast using an electron beam melting furnace is formed to 10 mm or greater with a layer composed of crystal grains whose C-axis direction inclination: ϕ of the hexagonal-close-packed structure, which is the α phase, as viewed from the side of the slab surface to be hot rolled, is at all measured points within the range of 35 to 90° from the direction of the normal to the surface to be hot rolled (where ND direction is defined as 0°).

In order to suppress post-hot-rolling surface defects more stably industrially, a surface layer composed of crystal grains whose ϕ range is 40 to 90° is desirable. It is considered possible to achieve a ϕ range of 40 to 90° by regulating the casting conditions at least so that the thickness of a surface layer structure whose θ is 75 to 90° is 10 mm or greater.

With an electron beam, since the beam can be condensed by polarization, heat is easy to supply even to the narrow region between the mold and the molten titanium, thus enabling good control of the casting surface and solidified structure.

When θ is controlled to 45 to 90° with an electron beam melting furnace, the molten titanium rapidly solidifies to separate the titanium from the mold surface by thermal contraction at a relatively early stage, so that an effect is exhibited of improving casting surface property by inhibiting seizure between the mold and titanium.

On the other hand, vacuum plasma melting (plasma arc) does not permit deflection as with the electron beam for electron beam melting, making it awkward at regulating the irradiation site in the melting furnace and the balance of the amount of heat supplied, which makes it difficult to obtain the solidified structure of the titanium slab for hot rolling of the present invention.

The foregoing is the result of mechanically machining the surface of the cast slab to remove pits, bumps and other surface defects of the casting surface, then hot rolling to a thickness of about 3 to 6 mm, thereafter performing a descaling process of shot blasting and nitric-hydrofluoric acid pickling, and visually evaluating the surface defects.

Preferably, in the titanium slab for hot rolling according to invention of this application, the thickness of the titanium slab is 225 to 290 mm and the ratio W/T of width W to thickness T is 2.5 to 8.0. When the thickness of the titanium slab exceeds 290 mm or W/T exceeds 8.0, the rolling load becomes great owing to enlarged slab cross-sectional area and seizure occurs between the rolling mill roll and the titanium, so that the post-hot-rolling surface quality may be degraded and the allowable load limit of the hot-rolling mill may be exceeded. Further, the solidification rate may no longer be easy to maintain high and control to θ of 45 to 90° may become difficult.

When, to the contrary, the thickness is thin, less than 225 mm, so that W/T is a small 2.5, the surfaces (upper and lower) near the slab edges are easily affected by heat loss from the mold corner portions and/or sides, so that θ, i.e., the solidification direction of the edge portion surface side, is sometimes hard to control to 45 to 90°.

In addition, when the thickness is thin, i.e., less than 225 mm, the load on the solidified shell becomes large when the extraction rate during casting rate is increased, which is undesirable also from the aspect of occurrence of solidified shell breakage and other problems. Further, when W/T is less than 2.5, the lateral spread owing to bulging at the start of hot rolling increases and sometimes develops into edge cracks and/or seam defects.

From the aspects of both the production efficiency when producing the slab for hot rolling with an electron beam melting furnace and the conveyance stability when rolling strip coil with a general purpose hot-rolling mill for steel or the like, it is preferable to make L/W, i.e., the ratio of the length L to the width W of the titanium slab for hot rolling, 5 or greater and the slab length 5000 mm or greater. Titanium is light, with 60% the density of steel, so that when the slab L/W is small and length short, reactive forces from the transport rollers and the like tend to cause slab flutter, and defects may occur on the post-hot-rolled surface under the influence thereof.

As pointed out above, the length of the slab is preferably 5000 mm or greater, more preferably 5600 mm or greater and still more preferably 6000 mm or greater, with an even more preferable mode being defined as 7000 mm or greater.

Next, explanation is given in the following regarding preferable modes of methods of producing the aforesaid titanium slab for hot rolling.

As shown in FIG. 5, the melting raw material for producing the titanium slab according to the invention of this application is charged into a hearth 3, is melted under irradiation of an electron beam 2 from the electron gun 1 installed above the hearth, combines with melt retained in the hearth 3, and is poured inside the mold 4 installed downstream of the hearth 3.

The melt 9 poured inside the mold 4 combines with a titanium melt pool 5 formed inside the mold 4, and the lower part of the titanium melt pool 5 is extracted downward in accordance with the extraction rate of the titanium slab 6 to solidify progressively and produce the titanium slab. The titanium slab is extracted while being supported by a pedestal 7 mounted on the head of an extraction shaft 8. Note that this extraction direction is the casting direction.

The titanium slab 6 produced to the prescribed length is taken out of electron beam melting furnace into the atmosphere. The interior of the electron beam melting furnace is maintained at a prescribed degree of vacuum, and the molten titanium and the high-temperature slab after production are in a reduced-pressure atmosphere and experience almost no oxidation. The front surface and side surfaces of the slab are then treated as required by machining to obtain a titanium slab for hot rolling that is subjected to a hot-rolling process.

In the invention of this application, the titanium slab for hot rolling produced with an electron beam melting furnace uses a rectangular mold and the extraction rate of the titanium slab extracted from the mold is made 1 cm/min or greater.

When the extraction rate of the titanium slab is less than 1.0 cm/min, the titanium melt pool 5 becomes shallow because the casting rate is slowed and the effect of heat flow between the mold and the titanium pool makes control of θ to 45 to 90° difficult. Further, a deposit produced by evaporation from the titanium melt pool 5 sometimes forms by adhering to the wall of the mold 4 above the titanium melt pool 5.

Further, when the extraction rate is slow, i.e., less than 1.0 cm/min, the aforesaid deposit grows large because the casting takes a long time, which is undesirable because it may fall between the walls of the titanium melt pool 5 and the mold 4 and may be entangled in the surface of the titanium slab 6 formed by solidification of the titanium melt pool 5, with the result that the casting surface of the produced titanium slab 6 is degraded. An extraction rate of 1.5 cm/cm or greater is more preferable because the cast structure and casting surface can be stably obtained in favorable condition.

There is no basis for setting an upper limit of the extraction rate from the viewpoint of controlling the cast structure and obtaining a good casting surface, but when the extraction rate of the titanium slab 6 exceeds 10 cm/min, breakout of unsolidified melt may occur owing to downward extraction of the titanium slab 6 from the mold 4 in a state not totally solidified, which is undesirable.

On the other hand, in the case of steel, the slab casting rate is about 100 to 300 mm/min, which is high compared with the case of the titanium of the present invention, but in the case of titanium, control to a non-oxidizing atmosphere is necessary for suppressing oxidation during melting and after solidification, so that the aspect of the casting rate (extraction rate) being limited structurally is strong.

Therefore, in the present invention, the extraction rate of the titanium slab extracted from the mold 4 is more preferably in the range of 1.5 to 10 cm/min.

As the casting surface of the titanium slab produced under the foregoing conditions is excellent, an effect is exhibited of making it possible to markedly minimize the machining or other surface treatment conducted prior to hot-rolling process. Moreover, depending on the casting surface properties, surface treatment can be made unnecessary. As a result, decline in yield owing to slab surface treatment can also be effectively suppressed.

In the invention of this application, the titanium slab produced in the aforesaid manner is markedly suppressed in occurrence of surface defects during hot rolling, and since it is formed in a shape ideal for feeding into a general purpose hot-rolling mill, it is possible to omit a process like the conventional one for breaking an ingot down to a slab suitable for hot rolling, as well as the ensuing straightening process.

Therefore, the titanium slab produced by the foregoing method exhibits the effect of enabling feeding, without passage through a pretreatment process such as described above, directly into a general purpose hot-rolling mill used for steel or the like, without passage through a breakdown process or the like.

Moreover, the titanium slab produced with an electron beam melting furnace before the aforesaid hot rolling is heated for hot rolling. In order to reduce deformation resistance, the heating temperature is preferably set in the range of 800° C. to 950° C. In addition, in order to suppress scale occurring during slab heating, the heating temperature is preferably lower than the β transformation point. Note that the titanium slab according to the invention of this application can efficiently fabricate an approximately 2 to 10 mm strip coil by hot rolling such as set out in the foregoing.

Thus, the titanium slab produced in accordance with the invention of this application exhibits an effect not only of being suitably subjected to hot rolling but also of the titanium flat material produced by the hot rolling being markedly suppressed in surface defects, and even if thereafter subjected to cold rolling, being capable of producing a sound sheet.

EXAMPLES

Examples 1

The present invention is explained in further detail using the following examples.

1. Melting raw material; Sponge titanium
2. Melting apparatus; Electron beam melting furnace 1) Electron beam output
   Hearth side; 1000 kW max
   Mold side; 400 kW max 2) Rectangular section mold
   Section size; 270 mm high×1100 mm wide
   Structure; Water-cooled steel plate 3) Extraction rate
0.2 to 11.0 cm/min 4) Other The point of irradiation (scan pattern) of the electron beam onto the peripheral region of the mold was regulated to favorably control the casting surface and solidified structure.

The aforesaid apparatus structure and raw material were used to produce slabs of JIS type 2 commercially pure titanium in various lengths of 5600, 6000, 7000, 8000 and 9000 mm. The surfaces of the produced titanium slabs were treated by machining to remove casting surface pits, bumps and other surface defects. The aforesaid method was then used to measure θ from the sectional structure (solidified structure).

In some, the amount of machining treatment was varied to regulate the thickness of the surface layer of θ of 70 to 90°. These titanium slabs were hot rolled into strip coil of around 5 mm thickness using hot rolling equipment for steel. After being shot blasted and nitric-hydrofluoric acid pickled, the strip coils were visually inspected for surface defects and judged for pass/fail in 1 m units of coil length to determine the pass rate in terms of the surface defect occurrence condition.

The surface defect occurrence condition (pass rate) was determined by identifying presence/absence of surface defects in unit segments of 1 m length of the coil after shot blasting and nitric-hydrofluoric acid pickling. A segment where no surface defects were present was passed and the pass rate was defined as number of pass segments/total number of segments×100(%). A pass rate of less than 90& was defined as fail (F), of 90% to less than 95% as good (G), and of 95% or greater as excellent (E).

In Table 1 is shown, for the case of a slab of 8000 mm length whose type was JIS type 2 commercially pure titanium, the cast slab casting surface condition, solidified structure of a longitudinal cross-section (θ at the level of one-quarter thickness, thickness of surface structure of θ of 70 to 90°), and surface defect occurrence condition of hot-rolled strip coil.

TABLE 1

| | | | | | Solidified structure of slab longitudinal cross-section | | | |
|---|---|---|---|---|---|---|---|---|
| | | Slab extraction rate at casting | Slab casting surface condition | | θ at ¼ thickness | Thickness of surface structure of θ of 70 to 90° | Surface defect occurrence condition of hot rolled strip coil #1 | |
| Example No. | Type | (cm/min) | Evaluation | Characteristics | level (°) | (mm) | Evaluation | Pass rate/defect characteristics |
| Invention 1 | Pure Ti JIS Type 2 | 1.0 | G | No adherents, good casting surface | 47 | 5 | G | 92%/scattered small defects of under 3 mm length |
| Invention 2 | Pure Ti JIS Type 2 | 1.2 | G | No adherents, good casting surface | 52 | Removed by machining | G | 91%/scattered small defects of under 3 mm length |
| Invention 3 | Pure Ti JIS Type 2 | 1.2 | G | No adherents, good casting surface | 52 | 11 | E | 97% |
| Invention 4 | Pure Ti JIS Type 2 | 1.5 | G | No adherents, good casting surface | 61 | Removed by machining | G | 93%/scattered small defects of under 3 mm length |
| Invention 5 | Pure Ti JIS Type 2 | 1.5 | G | No adherents, good casting surface | 61 | 5 | G | 94%/scattered small defects of under 3 mm length |

TABLE 1-continued

| Example No. | Type | Slab extraction rate at casting (cm/min) | Slab casting surface condition: Evaluation | Slab casting surface condition: Characteristics | Solidified structure of slab longitudinal cross-section: θ at ¼ thickness level (°) | Solidified structure of slab longitudinal cross-section: Thickness of surface structure of θ of 70 to 90° (mm) | Surface defect occurrence condition of hot rolled strip coil #1: Evaluation | Surface defect occurrence condition of hot rolled strip coil #1: Pass rate/defect characteristics |
|---|---|---|---|---|---|---|---|---|
| Invention 6 | Pure Ti JIS Type 2 | 1.5 | G | No adherents, good casting surface | 61 | 11 | E | 98% |
| Invention 7 | Pure Ti JIS Type 2 | 1.5 | G | No adherents, good casting surface | 61 | 20 | E | 98% |
| Invention 8 | Pure Ti JIS Type 2 | 2.0 | G | No adherents, good casting surface | 69 | 26 | E | 99% |
| Invention 9 | Pure Ti JIS Type 2 | 4.0 | G | No adherents, good casting surface | 74 | 32 | E | 98% |
| Invention 10 | Pure Ti JIS Type 2 | 5.0 | G | No adherents, good casting surface | 79 | 38 | E | 98% |
| Comparative 1 | Pure Ti JIS Type 2 | 0.2 | F | Many adherents | 22 | None | F | 52%/coarse defects of several tens of mm or greater |
| Comparative 2 | Pure Ti JIS Type 2 | 0.5 | Fair | Adherents pressent | 31 | None | F | 69%/coarse defects of several tens of mm or greater |
| Comparative 3 | Pure Ti JIS Type 2 | 11.0 | Discontinued due to surface overheating | | — | — | — | — |

#1 Pass rate determined by visually inspecting surface defects after shot blasting and nitric-hydrofluoric acid pickling and evaluating presence/absence of surface defects in 1 m units of coil.
The evaluation made was Fail (F) when the pass rate was less than 90%, Good (G) when 90% to less than 95%, and Excellent (E) when 95% or greater.

In Invention Examples 1 to 10 that had extraction rates of 1.0 to 5.0 cm/min, the casting surface of the produced titanium slab was good and no splash marks or other adherents were observed. On the other hand, in Comparative Example 1 and Comparative Example 2 that had extraction rates of less than 1 cm/min, which is the aforesaid lower limit, splash marks and other adherents formed by splashing from the titanium pool 5 were observed on the surface of the produced titanium slab. In the case of Comparative Example 3 in which the extraction rate was set highest at 11 cm/min, the surface temperature of the titanium slab 6 extracted from the mold 4 exhibited an abnormally high temperature, so the melting was discontinued.

In Invention Examples 1 to 10 whose extraction rates were 1.0 to 5.0 cm/min, θ of the solidified structure of the slab longitudinal cross-section at the level of one-quarter the thickness was 47 to 79°, i.e., 45° or greater, and the surface defect pass rate after hot rolling was 91% or greater, i.e., surface defects were suppressed. In addition, in Invention Example 3 and Invention Examples 6 to 10, in which the thickness of the surface structure of θ of 70 to 90° was 10 mm or greater, the post-hot-rolling surface defect pass rate was stable at a high level of 97% or greater.

Note that in Invention Example 2 and Invention Example 3, which had an extraction rates of 1.2 cm/min, and Invention Examples 4 to 7, which had ones of 1.5 cm/min, the amount of machining of the produced slab surface was varied to regulate the thickness of the surface layer of θ of 70 to 90°.

On the other hand, in Comparative Example 1 and Comparative Example 2, whose extraction rates were 0.2 and 0.5 mm/min, θ at the level of one-quarter the thickness was 22° and 31°, respectively, and both small at less than 45°, so that the post-hot-rolling surface defect pass rate was very low at less than 70% and coarse defects were observed.

Next, Table 2 similarly shows examples for JIS type 1 commercially pure titanium, and Ti-1% Fe-0.36% O (% is mass %) and Ti-3% Al-2.5% V (% is mass %), which are titanium alloys. The melting raw materials were prepared to obtain the target type composition under the aforesaid production conditions. Effects like those for JIS type 2 commercially pure titanium of Table 1 were also obtained when the type was JIS type 1 commercially pure titanium, Ti-1% Fe-0.36% O and Ti-3% Al-2.5% V.

TABLE 2

| Example No. | Type | Slab extraction rate at casting (cm/min) | Slab casting surface condition: Evaluation | Slab casting surface condition: Characteristics | Solidified structure of slab longitudinal cross-section: θ at ¼ thickness level (°) | Solidified structure of slab longitudinal cross-section: Thickness of surface structure of θ of 70 to 90° (mm) | Surface defect occurrence condition of hot rolled strip coil #1: Evaluation | Surface defect occurrence condition of hot rolled strip coil #1: Pass rate/defect characteristics |
|---|---|---|---|---|---|---|---|---|
| Invention 11 | Pure Ti JIS Type 1 | 1.0 | G | No adherents, good casting surface | 46 | 6 | G | 92%/scattered small defects of under 3 mm length |

TABLE 2-continued

| Example No. | Type | Slab extraction rate at casting (cm/min) | Slab casting surface condition Evaluation | Slab casting surface condition Characteristics | Solidified structure of slab longitudinal cross-section: θ at ¼ thickness level (°) | Solidified structure of slab longitudinal cross-section: Thickness of surface structure of θ of 70 to 90° (mm) | Surface defect occurrence condition of hot rolled strip coil #1 Evaluation | Surface defect occurrence condition of hot rolled strip coil #1 Pass rate/defect characteristics |
|---|---|---|---|---|---|---|---|---|
| Invention 12 | Pure Ti JIS Type 1 | 1.5 | G | No adherents, good casting surface | 60 | 22 | E | 97% |
| Invention 13 | Pure Ti JIS Type 1 | 4.0 | G | No adherents, good casting surface | 73 | 31 | E | 98% |
| Invention 14 | Ti—1% Fe—0.36% O | 1.5 | G | No adherents, good casting surface | 62 | 17 | E | 98% |
| Invention 15 | Ti—1% Fe—0.36% O | 4.0 | G | No adherents, good casting surface | 71 | 29 | E | 98% |
| Invention 16 | Ti—3% Al—2.5% V | 1.5 | G | No adherents, good casting surface | 63 | 18 | E | 98% |
| Invention 17 | Ti—3% Al—2.5% V | 4.0 | G | No adherents, good casting surface | 74 | 28 | E | 99% |
| Comparative 4 | Pure Ti JIS Type 1 | 0.5 | Fair | Adherents present | 32 | None | F | 65%/coarse defects of several tens of mm or greater |
| Comparative 5 | Ti—1% Fe—0.36% O | 0.5 | Fair | Adherents present | 30 | None | F | 73%/coarse defects of several tens of mm or greater |
| Comparative 6 | Ti—3% Al—2.5% V | 0.5 | Fair | Adherents present | 31 | None | F | 74%/coarse defects of several tens of mm or greater |

#1 Pass rate determined by visually inspecting surface defects after shot blasting and nitric-hydrofluoric acid pickling and evaluating presence/absence of surface defects in 1 m units of coil.
The evaluation made was Fail (F) when the pass rate was less than 90%, Good (G) when 90% to less than 95%, and Excellent (E) when 95% or greater.

In Invention Examples 11 to 17 that had extraction rates of 1.0 to 4.0 cm/min, the casting surface of the produced titanium slab was good and no splash marks or other adherents were observed. Even for different types, good casting surfaces were obtained at the prescribed extraction rate. On the other hand, in Comparative Examples 4 to 6 that had extraction rates of less than 1 cm/min, which is the aforesaid lower limit, splash marks and other adherents formed by splashing from the titanium pool 5 were observed on the surface of the produced titanium slab.

In Invention Examples 11 to 17 whose extraction rates were 1.0 to 4.0 cm/min, θ of the solidified structure of the slab longitudinal cross-section at the level of one-quarter the thickness was 46 to 74°, i.e., both were 45° or greater, and the surface defect pass rate after hot rolling was 92% or greater, i.e., surface defects were suppressed. In addition, in Invention Examples 12 to 17, in which the thickness of the surface structure of θ of 70 to 90° was 10 mm or greater, the post-hot-rolling surface defect pass rate was stable at a high level of 97% or greater.

On the other hand, in Comparative Examples 4 to 6, whose extraction rates were a slow 0.5 cm/min, θ at the level of one-quarter the thickness was about 30° and small at less than 45°, so that the post-hot-rolling surface defect pass rate was very low at less than 75% and coarse defects were observed.

Note that in Invention Examples 1 to 10 and Invention Examples 11 to 17, while the edges of the hot-rolled strip coil had very tiny cracks, they were in a substantially crack free condition, and the edge cracks caused no problem whatsoever even after ensuing cold rolling to a thickness of around 0.5 mm.

Thus, in Invention Examples 1 to 17 carried out in line with the present invention, it was confirmed that titanium slab excellent in casting surface and titanium flat material suppressed in surface defects during hot rolling can be effectively produced.

Next, by the procedure explained earlier, the crystal orientation of the titanium α phase (hexagonal-close-packed structure) at 10 mm depth level from the slab surface was determined by the Laue method for about 40 points per specimen. In Table 3 is shown, from these crystal orientations, the distribution range of angle: ϕ which is defined as the inclination, viewed from the surface of the slab to be rolled, of the titanium α phase (hexagonal-close-packed structure) C-axis direction from the direction of the normal to the slab surface to be rolled (where ND direction is defined as 0°).

As shown in Table 3, ϕ was in the range of 35 to 90° in Invention Example 3, Invention Examples 6 to 10 and Invention Examples 12 to 17, in which the post-hot-rolling surface defect pass rate was stable at a high level of 97% or greater.

On the other hand, ϕ was distributed in the range of 4 to 21° and less than 35° in Invention Examples 2, 4 and 11, and in Comparative Examples 1, 2, 4, 5 and 6, whose surface defect occurrence conditions were respectively "G (pass rate of 90% to less than 95%) and "F (pass rate of less than 90%). Further, it can be seen that in Comparative Examples 1, 2, 4, 5 and 6, ϕ was distributed in a still smaller range of 4 to 7° or greater.

TABLE 3

| Example No. | Type | Cited from Table 1 and Table 2: Solidified structure of slab longitudinal cross-section: θ at ¼ thickness level (°) | Thickness of surface structure of θ of 70 to 90° (mm) | Surface defect occurrence: condition of hot rolled strip coil Evaluation | Φ distribution range (C-axis inclination of titanium α phase viewed from side of slab to be rolled) |
|---|---|---|---|---|---|
| Invention 2 | Pure Ti JIS Type 2 | 52 | Removed by machining | G | 16 to 90° |
| Invention 3 | Pure Ti JIS Type 2 | 52 | 11 | E | 35 to 90° |
| Invention 4 | Pure Ti JIS Type 2 | 61 | Removed by machining | G | 21 to 90° |
| Invention 6 | Pure Ti JIS Type 2 | 61 | 11 | E | 36 to 90° |
| Invention 7 | Pure Ti JIS Type 2 | 61 | 20 | E | 38 to 90° |
| Invention 8 | Pure Ti JIS Type 2 | 69 | 26 | E | 39 to 90° |
| Invention 9 | Pure Ti JIS Type 2 | 74 | 32 | E | 40 to 90° |
| Invention 10 | Pure Ti JIS Type 2 | 79 | 38 | E | 42 to 90° |
| Invention 11 | Pure Ti JIS Type 2 | 46 | 6 | G | 13 to 90° |
| Invention 12 | Pure Ti JIS Type 2 | 60 | 22 | E | 38 to 90° |
| Invention 13 | Pure Ti JIS Type 2 | 73 | 31 | E | 40 to 90° |
| Invention 14 | Ti—1%Fe—0.36%O | 62 | 17 | E | 38 to 90° |
| Invention 15 | Ti—1%Fe—0.36%O | 71 | 29 | E | 41 to 90° |
| Invention 16 | Ti—3%Al—2.5%V | 63 | 18 | E | 40 to 90° |
| Invention 17 | Ti—3%Al—2.5%V | 74 | 28 | E | 41 to 90° |
| Comparative 1 | Pure Ti JIS Type 2 | 22 | None | F | 4 to 90° |
| Comparative 2 | Pure Ti JIS Type 2 | 31 | None | F | 7 to 90° |
| Comparative 4 | Pure Ti JIS Type 2 | 32 | None | F | 7 to 90° |
| Comparative 5 | Ti—1%Fe—0.36%O | 30 | None | F | 5 to 90° |
| Comparative 6 | Ti—3%Al—2.5%V | 31 | None | F | 6 to 90° |

INDUSTRIAL APPLICABILITY

The present invention relates to a method of efficiently producing a titanium slab produced using an electron beam melting furnace, and the slab, and, in accordance with the present invention, it is possible to efficiently provide a slab, which is a titanium slab to be hot rolled into a strip coil or flat material, particularly a titanium slab produced and cast using an electron beam melting furnace, which can be fed as is into a general purpose steel or the like hot-rolling mill for producing strip coil, without subjecting the cast slab to a breakdown process such as blooming or to a straightening process, to enable production of strip coil or flat material by hot rolling. Moreover, the slab of the present invention can suppress occurrence of strip coil or flat material surface defects. As a result, it is possible to greatly reduce energy and work cost to efficiently obtain a strip coil or flat material.

EXPLANATION OF REFERENCE SYMBOLS

1 Electron gun
2 Electron beam
3 Hearth
4 Mold
5 Titanium melt pool
6 Titanium slab
7 Pedestal
8 Extraction shaft
9 Melt

The invention claimed is:

1. A titanium slab for hot rolling characterized by being a titanium cast slab, in the cross-sectional structure of which titanium slab the angle formed by the casting direction and the solidification direction is in the range of 45 to 90°, wherein the titanium slab is made of either of alpha commercially pure titanium or alpha titanium alloy, and wherein the titanium slab has in the surface layer portion of the titanium slab a surface layer structure of a thickness of 10 mm or greater wherein the angle formed by the casting direction and the solidification direction is in the range of 70 to 90°.

2. A titanium slab for hot rolling as set out in claim 1 characterized in that the thickness of the titanium slab for hot rolling is 225 to 290 mm and ratio W/T of width W to thickness T is 2.5 to 8.0.

3. A titanium slab for hot rolling as set out claim 1, characterized in that ratio L/W of length L to width W of the titanium slab for hot rolling is 5 or greater and L is 5000 mm or greater.

4. A titanium slab for hot rolling as set out in claim 1, characterized in that the titanium slab for hot rolling is cast using an electron beam melting furnace.

5. A method of producing a titanium slab for hot rolling set out in claim 1, which is a method of producing a slab for hot rolling using an electron beam melting furnace, characterized in that an extraction rate of the titanium slab is in the range of 1.0 cm/min or greater.

6. A method of rolling a titanium slab for hot rolling characterized in that a titanium slab for hot rolling set out in claim 1 is fed into a hot-rolling mill to be hot rolled into a strip coil.

* * * * *